United States Patent [19]

Fletcher et al.

[11] 4,360,420

[45] Nov. 23, 1982

[54] DISTILLATION AND SOLVENT EXTRACTION PROCESS FOR REREFINING USED LUBRICATING OIL

[75] Inventors: Laird C. Fletcher, Natchitoches; Harold J. Beard, Baton Rouge; Richard O'Blasny, Natchitoches, all of La.

[73] Assignee: Delta Central Refining, Inc., Natchitoches, La.

[21] Appl. No.: 202,018

[22] Filed: Oct. 28, 1980

[51] Int. Cl.[3] ..... C10M 11/00; C10G 7/00; C10G 21/16

[52] U.S. Cl. ..... 208/184; 208/327; 208/355

[58] Field of Search ..... 208/180, 184, 355, 327

[56] References Cited

U.S. PATENT DOCUMENTS

| | | | |
|---|---|---|---|
| 1,584,588 | 5/1926 | Acheson | 208/180 |
| 2,583,620 | 1/1952 | Wrightson | 518/725 |
| 2,745,790 | 5/1956 | Manley | 208/327 |
| 3,024,171 | 3/1962 | Bone | 203/7 |
| 3,173,859 | 3/1965 | Chambers | 208/184 |
| 3,305,478 | 2/1967 | Gilson et al. | 208/180 |
| 3,450,627 | 6/1969 | Johnson et al. | 208/180 |
| 3,607,731 | 9/1971 | Gulick | 208/180 |
| 3,620,967 | 11/1971 | Gulick | 208/180 |
| 3,625,881 | 12/1971 | Chambers et al. | 208/180 |
| 3,763,036 | 10/1973 | Jordan et al. | 208/180 |
| 3,773,658 | 10/1973 | Va et al. | 208/180 |
| 3,791,965 | 2/1974 | Fitzsimons et al. | 208/179 |
| 3,864,242 | 2/1975 | Watanabe | 208/180 |
| 3,870,625 | 3/1975 | Wielezynski | 208/180 |
| 3,879,282 | 4/1975 | Johnson | 208/180 |
| 3,919,076 | 11/1975 | Cutler et al. | 208/180 |
| 3,923,643 | 12/1975 | Lewis et al. | 208/179 |
| 3,929,626 | 12/1975 | Button et al. | 208/180 |
| 3,954,602 | 5/1976 | Troesch et al. | 208/180 |
| 3,980,551 | 9/1976 | Wolk | 208/179 |
| 3,985,642 | 10/1976 | Friel et al. | 208/180 |
| 4,021,333 | 5/1977 | Habiby et al. | 208/180 |
| 4,029,569 | 6/1977 | Ivey, Jr. | 208/180 |
| 4,033,859 | 7/1977 | Davidson et al. | 208/179 |
| 4,038,176 | 7/1977 | Noren et al. | 208/180 |
| 4,045,330 | 8/1977 | Avrillon et al. | 208/180 |
| 4,071,438 | 1/1978 | O'Blasny | 208/180 |
| 4,073,719 | 2/1978 | Whisman et al. | 208/180 |
| 4,073,720 | 2/1978 | Whisman et al. | 208/180 |
| 4,097,369 | 6/1978 | Ebel et al. | 208/180 |
| 4,101,414 | 7/1978 | Kim et al. | 208/18 |
| 4,105,538 | 8/1978 | Mattox | 208/18 |
| 4,124,492 | 11/1978 | Fung et al. | 208/180 |
| 4,140,212 | 2/1979 | O'Blasny et al. | 196/114 |
| 4,191,640 | 3/1980 | Chess | 208/355 |

FOREIGN PATENT DOCUMENTS

| | | | |
|---|---|---|---|
| 49-69702 | 7/1974 | Japan . | |
| 53-19004 | 6/1978 | Japan | 208/180 |
| 7711298 | 4/1979 | Netherlands | 208/184 |

OTHER PUBLICATIONS

"Evaporators: Use in Re-refining", published in *Hydrocarbon Processing,* Jul. 1979.

"Waste Lubricating Oil Research", published in *Bureau of Mines Report of Investigations/* 1974-RI 7884 and 7925.

*Reprocessing and Disposal of Waste Petroleum Oils,* by L. Y. Hess, published by Noyes Data Corporation.

*Petroleum Refinery Engineering* by W. L. Nelson, published by McGraw-Hill Book Company.

*Primary Examiner*—T. M. Tufariello

*Attorney, Agent, or Firm*—Winburn & Gray, Ltd.

[57] ABSTRACT

Used oil is rerefined by distillation and extraction with tetrahydrofurfuryl alcohol. In accordance with the process, used oil is rerefined by distillation to remove a volatile forecut followed by further distillation with recirculation provisions to obtain the desired fractions of lubricating oil products while reducing the vaporization temperature of the oil. The recycle effect tends to reduce coking and cracking while providing a greater recovery of lubricating oil products through the carrier effect of the light ends. After the desired fractions of lubricating oil have been obtained by the distillation phase of the process, tetrahydrofurfuryl alcohol is utilized in an extraction process to remove impurities remaining in the distilled oil. The tetrahydrofurfuryl alcohol-lube oil mixture is separated into a raffinate and extract stream for distilling and steam stripping the tetrahydrofurfuryl alcohol therefrom.

In one embodiment of the invention, a waste oil feedstock has water, gasoline and other similarly volatile components removed in a first stage evaporator (16). Heavier fuel, such as fuel oil is then removed in the second stage evaporator (28). A light lube oil fraction is then obtained by distillation with a third stage wiped-film evaporator (40). Finally, a heavy lube oil fraction is obtained by distillation of the bottoms from the evaporator (40) in a fourth-stage with a wiped-film evaporator (64). The heavy and light lube oil fractions are then treated in the fifth stage of the process in which each of the lube oil fractions mix with tetrahydrofurfuryl alcohol in extraction columns (80) and (96). Each of the tetrahydrofurfuryl alcohol and oil fractions are then separated into raffinate and extract streams for further treatment to further separate and recover the finished light and heavy lube oil products and tetrahydrofurfuryl alcohol which is reused in the fifth stage of the process.

29 Claims, 3 Drawing Figures

DISTILLATION AND SOLVENT EXTRACTION PROCESS FOR REREFINING USED LUBRICATING OIL

TECHNICAL FIELD

This invention relates to the rerefining of used lubricating oil. More particularly, this invention relates to the rerefining of used lubricating oil by distillation followed by solvent extraction.

BACKGROUND ART

This invention relates to a process for the reclamation and rerefining of waste hydrocarbon lubricating oils. In particular, the invention incorporates distillation and solvent extraction in a process for removing impurities from waste oil. The distillation portion of the process reduces coking, cracking and fouling tendencies that are inherent in other distillation rerefining processes while increasing the yield of product.

Each year large and increasing volumes of used lubricating oil, particularly crankcase oils from diesel, gasoline and other internal combustion engines are produced. These waste oils are contaminated with oxidation and degradation products, water, fine particulates including metal, and carbon oil additive products. These contamination components render the oils unsuitable for continued use. Waste oils have generally been disposed by incineration, in land fill, or used in road oiling for dust control, because the cost of reclamation and rerefining has been excessive. However, because of the rising cost of hydrocarbon fuels and lubricants, coupled with the ever-increasing demand and depletion of resources, the need for an efficient, low-cost waste oil rerefining process has arisen.

In recent years, some small scale rerefining processes have been put into operation in which marketable oils are recovered. However, due to the high costs involved and the resulting narrow profit margin, such recovery processes represent a small percentage utilization of the total quantity of used lubricating oils.

The ever-increasing scarcity and consequent rising costs of petroleum, particularly high quality lubricating stocks, now presents positive incentives to selectively remove undesirable contaminants from used motor oils and reuse the valuable high quality lubricating components contained in such oils. Several waste oil rerefining processes are known from the prior art. For example, in U.S. Pat. No. 3,639,229, a process is described where a mixture of an aliphatic monohydric alcohol of from 4 to 5 carbon atoms and a light hydrocarbon is added to waste oil. The mixture settles into three distinct layers. The upper oily layer is recovered, treated with sulfuric acid and thereafter refined by conventional means. In U.S. Pat. No. 3,919,076, a process is described that involves removing water from the waste oil, adding the saturated hydrocarbon solvent, settling the mixture to recover the oil/solvent mix, removing the solvent, vacuum distilling the residual oil to collect selected fractions, hydrogenating the fractions in the presence of a catalyst, stripping hydrogenated oil to remove light ends and filtering the remaining product. U.S. Pat. No. 4,124,492 discloses a process for reclaiming useful hydrocarbon oil from contaminated waste oil in which the waste oil is dehydrated and, thereafter, the dehydrated oil is dissolved in selected amounts of isopropanol. The undissolved waste matter is separated and the residual oil/solvent fraction is distilled to recover the decontaminated oil and solvent. The recovered oil is further clarified by treatment with a bleaching clay or activated carbon at elevated temperatures. In U.S. Pat. No. 4,021,333, a process is described for rerefining used oil that includes distilling of a volatile forecut from the oil, followed by a conventional type of distillation that may occur at reduced pressure. Use of a demister is preferred to minimize carry-over of material into the distillate. The distillation is continued until the desired recovery is obtained followed by extraction of the impurities present in the distillate.

Thus, a need has arisen for an effective process for purifying waste oil that is economical and which provides increased recovery of lubricating oil.

DISCLOSURE OF THE INVENTION

In accordance with the present invention, a process is provided for rerefining used oil containing lubricating oil. The method in accordance with the present invention utilizes distillation followed by solvent extraction with tetrahydrofurfuryl alcohol. The distillation portion of the process reduces the tendency of the used oil to coke, crack and foul the equipment. Further, a specific type of recycle that forms part of the process also allows greater recovery of lubricating oil products during distillation through a "carrier effect" of the light ends.

Thus, in one aspect, the present invention relates to the increased yield of recovered lubricating oil without subjecting the waste oil feedstock to temperatures that create conditions that can cause coking, cracking or fouling. In another aspect, this invention relates to a process for varying the recycle of light ends to achieve the desired viscosity of lubricating oil. Still another aspect of this invention relates to reducing the temperature while achieving the desired recovery of lubricating oil from the waste oil feedstock.

In accordance with the present invention, the waste oil feedstock undergoes an initial distillation in which a volatile forecut is removed from the used oil to provide a resulting oil containing lubricating oil. This distillation may also remove water, gasoline, and the like. Or these components may be removed prior to this distillation. Thereafter, the resulting oil is distilled to form heavy and light fractions, with a portion of the light fraction being recycled and mixed into the resulting oil prior to distillation of the resulting oil in a quantity effective for lowering the vaporization temperature to reduce the tendency of coking, cracking and fouling during distillation and to increase the recovery of lube oil.

In accordance with another aspect, the present invention further includes distilling the heavy fraction obtained from the distillation to form a heavy lube fraction and a residual fraction. Further, the distillation of the heavy fraction can also include a recycle of a portion of the heavy lube oil fraction into the heavy fraction prior to distillation of the heavy fraction for lowering the vaporization temperature to reduce the tendency of coking, cracking and fouling during distillation and to increase the recovery of heavy lube oil. Generally, the amount of distillate recycled to the resulting fraction or heavy fraction prior to distillation is between about 5% and 300% by weight of the fraction to be distilled.

Further, in accordance with one embodiment of the distillation phase of the process, used oil containing a lubricating oil is rerefined by distilling the used oil to remove a volatile forecut to provide a resulting oil containing lubricating oil. Thereafter, the resulting oil is distilled in an agitated thin film evaporator or a wiped-film evaporator or any other suitable heat transfer device to form heavy and light fractions with lubricating oil being contained in the light fraction. The heavy fraction obtained from the distillation of the resulting oil is further distilled in an agitated thin film evaporator or a wiped-film evaporator or any other suitable heat transfer device to form a heavy lube fraction and a residual fraction.

In accordance with the extraction phase of the process, the used oil that has been fractionated into a light lube oil and a heavy lube oil includes mixing the heavy lube oil with an effective amount of tetrahydrofurfuryl alcohol for removing impurities from the heavy lube oil. Thereafter, the heavy oil is separated from the tetrahydrofurfuryl alcohol containing impurities removed from the oil. The light lube oil fraction is also mixed with an effective amount of tetrahydrofurfuryl alcohol for removing impurities from the light lube oil. After mixing, the light lube oil is separated from the tetrahydrofurfuryl alcohol containing impurities removed from the oil.

In accordance with one preferred embodiment of the present invention, the heavy lube oil and tetrahydrofurfuryl alcohol mixture is separated to form a heavy oil raffinate and a tetrahydrofurfuryl alcohol extract. The light lube oil and tetrahydrofurfuryl alcohol mixture is similarly separated into a light lube oil raffinate and a tetrahydrofurfuryl alcohol extract. Thereafter, the tetrahydrofurfuryl alcohol is removed from the heavy lube oil raffinate by distilling and steam stripping. Similarly, the tetrahydrofurfuryl alcohol is removed from the light lube oil raffinate by distilling and steam stripping. The extracts from the extraction units for each of the heavy and light lube fractions are combined and the tetrahydrofurfuryl alcohol is distilled and stripped from the mixture. The solvent is then condensed for reuse in extracting impurities from the light and heavy lube fractions.

Use of tetrahydrofurfuryl alcohol in accordance with the invention provides a greater selectivity and higher yields of raffinate while having a greater affinity for contaminants found in used lubricating oil.

BRIEF DESCRIPTION OF DRAWINGS

The invention can be more completely understood by reference to the accompanying drawings, in which.

DETAILED DESCRIPTION

Figure 1:
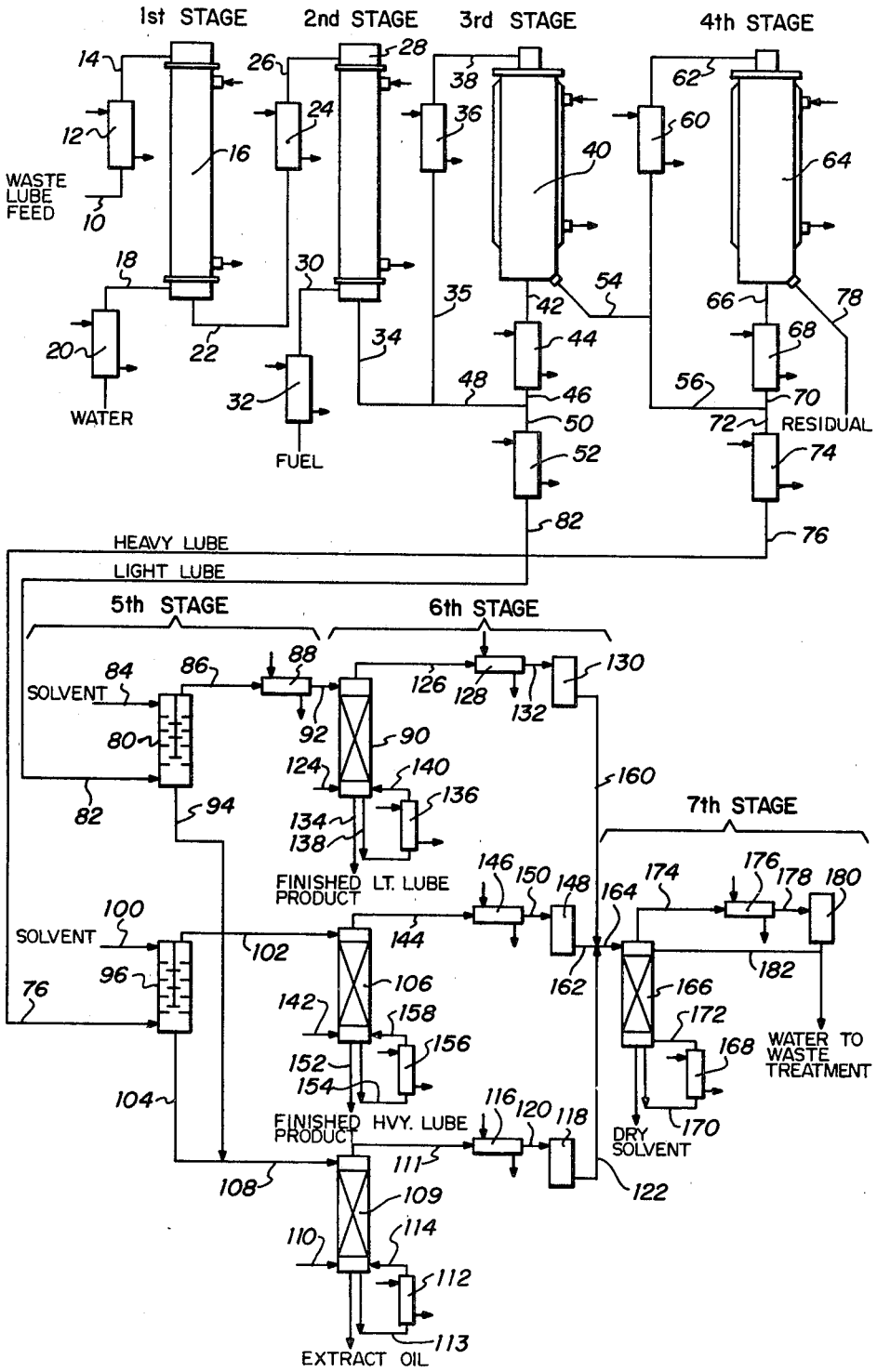
FIG. 1 is a schematic flow sheet of a preferred embodiment of the present invention.

In accordance with the present invention, an improved process is provided for rerefining used lubricating oil. Thus, in general, the method of this invention is applicable to any used oil that contains lubricating oil. Most often, the used oil that is most readily obtainable is used crankcase oils from motor vehicles, used lubricating oils from machinery and equipment, transmission fluids and other fluids in which the major constituent is an oil of lubricating viscosity. As used in this specification, the oils referred to will be petroleum-based oils (i.e., mineral oils), but it is to be understood that synthetic oils may be substituted therefor.

Stated broadly, the method of this invention includes the following steps for treating used lubricating oil feedstocks which are often collected as drainings from the crankcases of diesel, gasoline and other types of internal combustion engines. The used oil feedstock is distilled to remove any water, gasoline, and other similarly volatile components therefrom. This first stage generally operates at or near atmospheric pressure although this is not critical. When the first stage is operated at atmospheric pressure, the feedstock is generally heated in the range between about 220° F. and about 400° F. The optimum temperature for the first stage is dependent on the feedstock contaminants of water and volatile fuels and the residence time allowed for removing these components from the feedstock.

In the second stage, the residue from the first stage is heated so as to achieve a temperature in the range between about 250° F. and 500° F. The residue from the first stage is then distilled in the second stage to remove a forecut of fuel oil volatility (components that are heavier and somewhat less volatile than those removed in the first stage). This distillation stage preferrably operates at a reduced pressure, generally in the range of about 20 to about 150 millimeters mercury absolute, this preferred reduced pressure and temperature range is selected so as to remove all desired components, such as fuel oil, and will generally require a pressure of about 150 millimeters of mercury absolute with a residual lube oil exit temperature generally of approximately 460° F. to 500° F. Preferrably, the volatile forecut has flash point of less than about 116° C.

The first two stages, as previously described, can be accomplished in a single stage at reduced pressure between about 20 and 150 millimeters mercury absolute for removal of all components of water, gasoline and other volatile fuels together with somewhat less volatile components, such as fuel oil. This would then necessitate further operation of the various fuels and water that has been removed from the feedstock. Preferably, the used oil is distilled to remove therefrom a forecut having a viscosity less than that of lubricating oil in that the flash point is less than about 116° C., thereby providing a resulting residue oil containing oil of lubricating viscosity.

In the third stage, the first removal of lube oil products occurs. This stage operates in a pressure range between about 2 and 5 millimeters of mercury absolute and in a temperature range between about 265° F. and 500° F. These ranges of pressure and temperature generally provide a recovery (without recirculation) of between about 5 and 56% by weight of the feedstock for typical used lubricating oils. These percentages may be expected to vary based on the distillation characteristics of the feedstock in addition to the operating conditions imposed on the third-stage distillation unit. To substantially increase the removal of lube oil and additionally reduce vaporization temperatures, recirculation of the distilled product is employed. Generally the viscosity of the oil removed in third stage is between about 60 SSU and 200 SSU at 100° F.

The recirculation of vaporized products substantially increases the recovery of lube oil through the carrier effect or partial-pressure effect. Listed in Table 1 are the improvements and associated recovery percentages based on four values of recirculation (0%, 50%, 100%, and 200%) to produce four different overhead products from a typical feedstock. One major improvement provided by recirculation of the distillate is the lowering of the effective vaporization temperature of the feedstock. This allows increased recovery and lower operating temperatures while greatly reducing the tendency for coking or cracking of the feedstock to occur. In addition, any tendency for the equipment to become fouled is also reduced. In order to more completely understand the present invention, it is important to understand the distinction between reflux and recirculation of distillate. Reflux is the principle of returning a portion of condensed overhead product from a distillation tower to the top or side of the tower. The purpose of reflux is to improve fractionation. In contrast, recirculation of distillate, as used in accordance with the present invention, is the principle of returning a portion of the condensed vapor to the feedstock whereby its "carrying" or partial pressure effect can reduce the vaporization temperature of the feedstock.

TABLE 1

| ATMOSPHERIC VAPORIZING TEMPERATURE | AMOUNT OF FEEDSTOCK VAPORIZED, WEIGHT PERCENT | | | |
|---|---|---|---|---|
| | 580° F. | 700° F. | 800° F. | 820° F. |
| Flash Vaporization (Feedstock-0% Recirculation) | 5.0 | 17.5 | 48.0 | 56.3 |
| 50% Recirculation | 10.0 | 27.2 | 60.5 | 68.9 |
| 100% Recirculation | 17.4 | 32.3 | 66.5 | 77.5 |
| 200% Recirculation | 22.4 | 36.2 | 70.2 | 79.8 |

Figure 2:
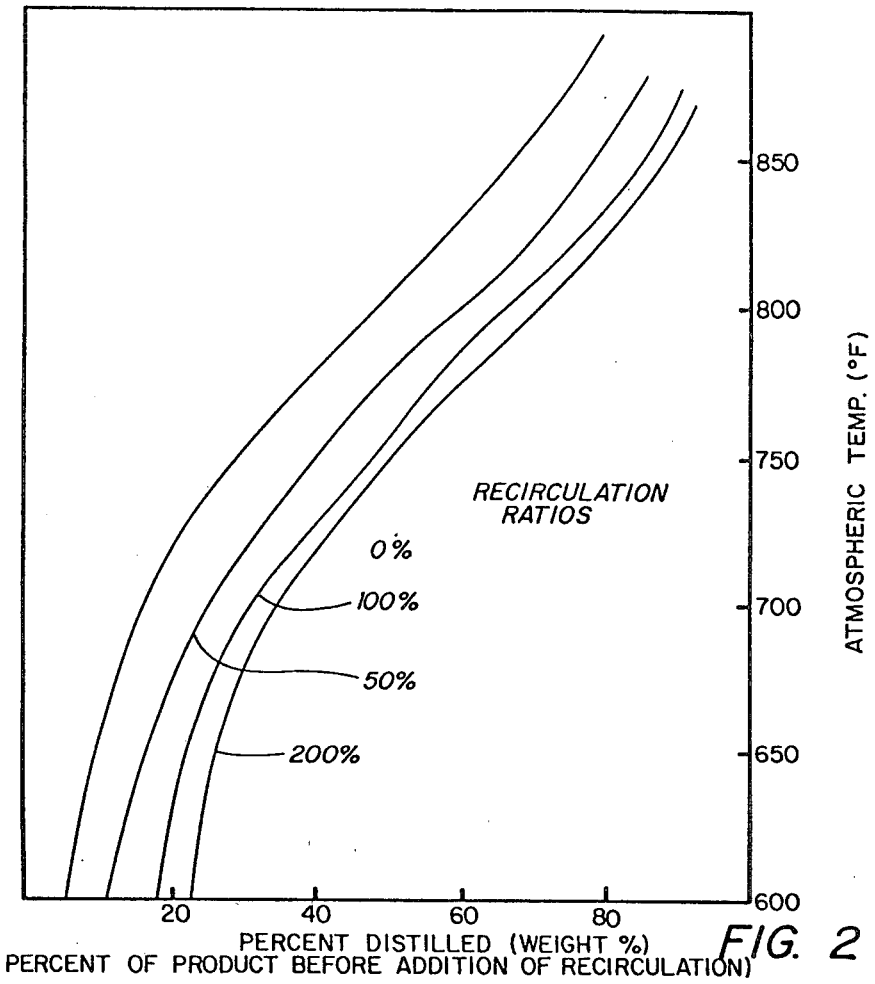
FIG. 2 is a graph depicting the effect of the recirculation ratio on the amount of used oil distilled as a function of atmospheric temperature for distillation of a typical waste oil in accordance with the invention, having water and a volatile forecut removed therefrom.

The values shown in Table 1 were obtained from the Distillation Curve depicted in FIG. 2.

Thus, the combination of pressure, temperature, and recirculation ratios outlined in Table 1 provides, for a typical waste oil, a range of lube distillate removal from the third stage between 5 to 79.8 weight percent of the feedstock to this stage. By adjusting the specific parameters of pressure, temperature, and recirculation ratio, a specific product characteristic can be obtained under lower temperature operating conditions compared to a system with no recirculation. Additionally, if product recovery in the third stage is desired without additional stages, the upper limits of recirculation can be utilized to maximize recovery.

In the fourth stage, a heavy lube oil fraction is removed as a product, which leaves behind a very heavy viscous residue (generally about 3,000 to 35,000 SSU at 210° F.). Operation of the fourth stage is similar to that of the third stage in that the operating pressure, temperature, and recycle rate can be varied to produce heavy lube oil products with various properties desired by various end-users. In the fourth stage, the recycling of distilled product has the same effects as previously described for the third stage namely, increased recovery of lube oil products, reduction of the vaporization temperature, and reduced risks of coking and cracking of the feedstock.

Operating conditions for the fourth stage are generally a pressure of between about 0.5 to 3.0 millimeters of mercury absolute and a temperature of between about 315° F. and 600° F. The preferred operating conditions are a pressure of about 0.5 millimeter of mercury absolute and a temperature range of 550° F. and 650° F. However, as previously stated with respect to the third stage, these conditions can be varied to alter the properties of the product or to change the fraction of the feed which is vaporized and recovered as product. Further, these parameters may change depending on the type of feedstock. Generally, the viscosity of the lube oil obtained in the fourth stage is between about 200 SSU and 1200 SSU at 100° F.

The recirculation of the vaporized product increases the recovery of heavy lube oil through the carrier effect or partial-pressure effect. Listed in Table 2 are improvements and associated recovery percentages based on four values of recirculation (0%, 50%, 100% and 200%) for each of four different overhead products for a typical feedstock. One major improvement attained by the recirculation is the lowering of the effective vaporization temperature of the feedstock. This allows increased recovery of heavy lube distilled in the fourth stage while reducing the risk of coking, cracking, and fouling.

TABLE 2

| ATMOSPHERIC VAPORIZING TEMPERATURE | AMOUNT OF FEEDSTOCK VAPORIZED, WEIGHT PERCENT | | | |
|---|---|---|---|---|
| | 800° F. | 850° F. | 900° F. | 940° F. |
| Flash Vaporization (No Recirculation | 16.4 | 40.5 | 62.2 | 77.5 |
| 50% Recirculation | 20.7 | 47.2 | 66.9 | 78.0 |
| 100% Recirculation | 22.7 | 51.0 | 71.5 | 81.0 |
| 200% Recirculation | 24.0 | 52.7 | 73.9 | 82.7 |

Figure 3:
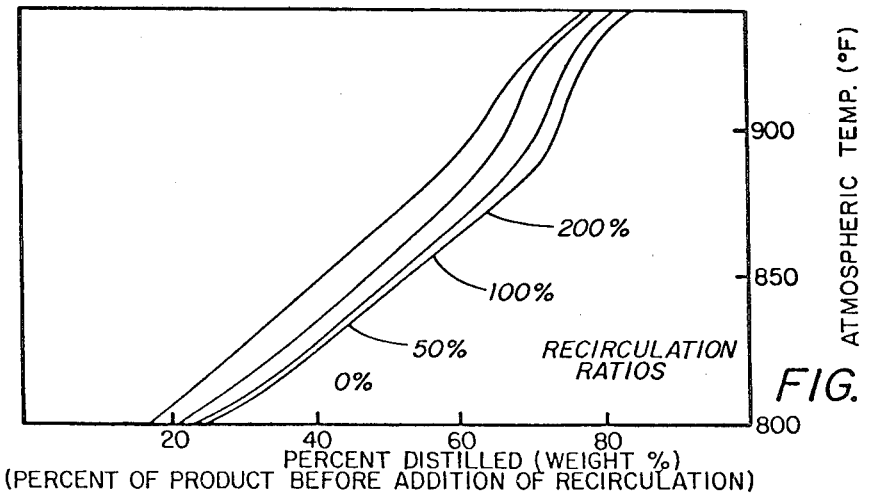
FIG. 3 is a graph depicting the effect of the recirculation ratio on the amount of used oil distilled as a function of atmospheric pressure for distillation of the heavy fraction obtained in accordance with the present invention.

The values set forth in Table 2 were obtained from the Distillation Curve set forth in FIG. 3. A variable recirculation rate capability together with changes in pressure and temperature allow for achieving maximum recovery of heavy lube oil in stage 4 of the process.

In accordance with the fifth stage of the process, the used oil that has been fractionated into a light lube oil is mixed with an effective amount of tetrahydrofurfuryl alcohol for removing impurities from the light lube oil. Also occuring in the fifth stage, but in a separate extraction column, the used oil that has been fractionated into a heavy lube oil is mixed with an effective amount of tetrahydrofurfuryl alcohol for removing impurities from the heavy lube oil. Thereafter, the light and heavy lube oil is separated from the tetrahydrofurfuryl alcohol together with removed impurities. Thus, for each of the heavy and light lube oil fractions, an oil raffinate and a tetrahydrofurfuryl alcohol extract are obtained. The tetrahydrofurfuryl alcohol is removed from the heavy lube oil raffinate by distilling and steam stripping in a sixth stage. Similarly, the light lube oil raffinate has the tetrahydrofurfuryl alcohol removed therefrom.

In a sixth stage, the extracts from the extraction units for each of the heavy and light lube oil fractions are combined and the tetrahydrofurfuryl alcohol solvent is distilled and stripped from the mixture. The solvent is then condensed for reuse in extracting impurities from the light and heavy lube oil fractions. Also in the sixth stage, the raffinates for each of the heavy and light lube oils have the THFA steam distilled and stripped therefrom in separate columns.

In the final stage of the process, the tetrahydrofurfuryl alcohol recovered from distilling and steam stripping the raffinates and the combined extracts is combined for further purification to allow for reuse of the tetrahydrofurfuryl alcohol in the beginning of the extraction phase of the rerefining process.

In accordance with the preferred embodiment of the present invention, the distillation in stages three and four is performed in an agitated thin film evaporator or a wiped-film evaporator in any other suitable heat transfer device.

The process can be more completely understood by reference to FIG. 1, which is a schematic depiction of a preferred embodiment of the process. Waste oil feedstock is pumped through a line 10 and heated by a heat exchanger 12 to a temperature in the range of between about 100° F. and 200° F. Thereafter, the feedstock exits heat exchanger 12 and enters a line 14. Upon exiting line 14, the feedstock enters a first-stage evaporator 16 that generally operates at or near atmospheric pressure. First-stage evaporator 16 heats the feedstock to a temperature in the range of between about 220° F. and 400° F. so as to remove essentially all water, gasoline, and other volatile components. The water, gasoline, and other volatile components that are removed from the feedstock exit through a line 18 and are condensed and cooled with a heat exchanger 20. Thereafter, the water, gasoline, and other volatiles that have been removed from the feedstock can be separated into fuel and water by conventional separation techniques.

The oil that exits the first stage is pumped through a line 22 and is heated by a heat exchanger 24 to a temperature in the range of between about 300° F. and 400° F. After heating in heat exchanger 24, the oil flows through a line 26 and into the second stage.

In the second stage of the process, the oil is treated in a second-stage evaporator 28. Second-stage evaporator 28 operates at a reduced pressure, generally in the range of between about 20 to 150 millimeters of mercury absolute. In the second stage, the oil is heated to a temperature in the range of between about 250° F. and 500° F. Second-stage evaporator 28 removes by vaporization the heavier fuel oil components present in the waste oil reaching the second stage. The heavier fuel that is removed in this stage exits second-stage evaporator 28 through line 30 and is thereafter condensed and cooled in a heat exchanger 32. The oil that has not been removed from the second-stage exits second-stage evaporator 28 through line 34. The oil in line 34 flows into a line 35 and is heated in a heat exchanger 36 and into a line 35 and is heated in a heat exchanger 36 and exits heat exchanger 36 into a line 38. Thereafter, the oil enters the third stage 40 for further treatment. Heat exchanger 36 heats the oil to a temperature generally in the range of between about 350° F. and 450° F.

A third-stage evaporator 40 afore described is utilized and operates at a reduced pressure, generally in the range of between about 2 and 5 millimeters of mercury absolute at a temperature of between about 265° F. and 500° F. Light lube oil is vaporized in third-stage evaporator 40 and exits into a line 42. Line 42 carries the light lube oil that has been vaporized into a heat exchanger 44 where the vaporized light lube oil is condensed and cooled to a temperature that is substantially the same temperature as line 34. This resultant light lube oil product then exits heat exchanger 44 and enters a line 46. Line 46 is split into two separate lines, 48 and 50. It is this split of line 46 that forms the recirculation of the light lube oil into the input to the third stage through line 48 and then line 35, mixing with the product from line 34. Thus, it is necessary to have a suitable valve or other arrangement so that the desired split of line 46 can be attained. The light lube oil entering line 48 is the oil that is recirculated and is combined with the waste oil exiting line 34 to form line 35. The desired recirculation percentage of line 48, as compared to line 34, is a controlled flow as determined by desired operating parameters. Preferably, the flow in line 48 can be changed from about 0 to about 300 weight percent of the flow in line 34. Thus, the feed in lines 35 and 38 consists of the combination of lines 34 and 48. For example, if 100% recirculation is desired, the weight flow in line 34 equals the weight flow in line 48. The light lube oil that forms line 50 is further cooled in a heat exchanger 52.

The residual product of the third stage evaporation exits third-stage evaporator 40 and enters line 54 where it is mixed with a line 56 to form a line 58 that enters a heat exchanger 60. Line 56 is the recirculation line of the fourth stage evaporation. Heat exchanger 60 heats the product in line 58 to a temperature in the range of between about 400° F. and 490° F. The product then exits heat exchanger 60 and enters a line 62 that feeds into a fourth-stage evaporator 64. Fourth-stage evaporator 64 operates at a reduced pressure, generally in the range of between about 0.5 and 3 millimeters of mercury absolute and at temperatures in the range of between about 315° F. and 630° F. The heavy lube oil vaporized in the fourth-stage is removed from fourth-stage wiped-film evaporator 64 through a line 66 and is condensed and cooled with a heat exchanger 68 to a temperature that is substantially the same temperature as the temperature of line 54. This product of heavy lube oil is then directed through a line 70 where it is split into two lines, 56 and 72. As previously discussed with respect to the third stage, the desired recirculation percentage is determined by the flow rate of line 56 and line 54. These are controlled flows as determined by desired operating conditions. The flow rate of line 56 can preferably be changed from about 0 to about 300 weight percent based on the flow of line 54. The flow not needed for recirculation is then subcooled in a heat exchanger 74 and may be transferred via a line 76 to storage to await further treatment or for use. The residual product of the fourth stage exits fourth-stage evaporator 64 into a line 78 where it is transferred to storage.

The light lube fraction enters an extraction device 80 via a line 82. Extraction device 80 for example is a rotary disc contactor or any other suitable device for bringing the two phases into intimate contact. Tetrahydrofurfuryl alcohol enters extraction device 80 via a line 84. Tetrahydrofurfuryl alcohol, hereinafter referred to as "THFA" is also known as tetrahydrofuryl carbinol and has the following molecular formula: $C_4H_7OCH_2OH$. THFA is a colorless liquid having a mild odor that is miscible with water and has a specific gravity of about 1.054 at 20° C. THFA is hygroscopic and is generally believed to have low toxicity. For example, see the Condensed Chemical Dictionary, 9th Edition published by Van Nostrand Reinhold.

Preferably, the light lube oil fraction and THFA entering extraction device 80 are at a temperature of approximately 150° F. Upon entering extraction device 80, the light lube fraction and THFA are thoroughly mixed in the preferred embodiment of the present invention, the volume ratio of light lube oil to THFA is about 1:1. This parameter is not a limitation upon the present invention.

An oil-rich top layer or raffinate exits through a raffinate line 86 from extraction device 80. The raffinate generally contains about 95% oil and about 5% THFA by weight. The raffinate exits line 86 and enters heat exchanger 88 for heating the raffinate to a temperature of approximately 200° F. After heating in heat exchanger 88, the raffinate is directed to a distillation tower 90 via a line 92. The extract exit extraction column 80 via a line 94 to be combined with another line as hereinafter described for distillation and steam stripping.

As shown in FIG. 1, the heavy lube fraction is treated in a manner similar to the treatment for the light lube fraction previously described. The heavy lube oil fraction enters an extraction column 96 via a line 76. The THFA enters extraction column 96 via a line 100. Preferably the heavy lube oil fraction and THFA entering extraction column 96 are at a temperature of approximately 225° F. The THFA and heavy lube oil are then mixed in extraction column 96 from which exit a raffinate line 102 and an extract line 104. Raffinate line 102 generally contains about 95% oil and 5% THFA by weight. Extract line 104 generally contains by weight about 95% THFA and 5% oil plus the impurities that were removed in the extraction process. Raffinate line 102 is then directed to a heavy oil raffinate distillation and steam stripping column 106, which is hereinafter described.

The extract lines 94 and 104 are combined into a single extract line 108 which is directed to a distillation and steam stripping tower 109. Distillation and steam stripping tower 109 is utilized to distill and steam strip the THFA from the extract. A steam line 110 delivers steam to distillation and steam stripping column 109. The solvent is distilled from the extract and is stripped, exiting through a distillate line 111. Distillation and steam stripping column 109 is preferably operated at a pressure of about 20 millimeters mercury absolute and a temperature at about 160° F. A steam reboiler 112 is utilized to provide additional heat for stripping tower 109 with a line 113 exiting the column 109 and entering reboiler 112 which discharges into column 109 via a line 114. After the solvent is distilled, it is condensed by a condenser 116, thereafter entering a storage tank 118 via a line 120. Solvent is removed from storage tank 118 via a line 122 for further treatment as hereinafter described.

As shown further in FIG. 1, the light oil raffinate is distilled and steam stripped in distillation and steam stripping tower 90. Distillation and steam stripping tower 90 is preferably operated at a temperature of about 140° F. and an absolute pressure of about 10 millimeters mercury. Steam is injected through a steam line 124 into tower 90. The solvent is distilled and stripped exiting into a distillate line 126. Thereafter, the distillate THFA is condensed in a condenser 128. The condensed THFA thereafter enters a storage vessel 130 via a line 132 where the THFA is stored for further treatment which is hereinafter described.

The residue or finished light lubricating oil exits tower 90 through a residue line 134, where it is transferred to storage or to further treatment. Final treatment before actual use as a lubricant may include polishing steps and the addition of specific additives. A steam reboiler 136 may be utilized to provide additional heat for tower 90 with a line 138 exiting tower 90 and entering reboiler 136 which discharges into tower 90 via a line 140.

The distillation and steam stripping of the heavy lube oil raffinate is similar to the distillation and steam stripping of the light oil raffinate previously described. The heavy oil raffinate enters distillation and steam stripping column 106 via line 102. Steam is injected into stripping column 106 via line 142. The solvent is distilled and stripped, exiting column 106 via a distillate line 144. The THFA distillate is condensed in a condenser 146 where it is thereafter transferred to a storage vessel 148 via a line 150. The distilled THFA is stored for further treatment, which is hereinafter described. The residue or finished heavy oil exits stripping column 106 through a residue line 152. Thereafter the finished heavy lube oil may be subjected to further treatment, such as polishing steps or additives may be blended into the heavy lube product depending on the desired use.

Distillation and steam stripping column 106 may also include a reboiler for introducing additional energy into the distillation and steam stripping process. A line 154 exits stripping column 106 and enters a steam heated reboiler 156 which discharges into a steam stripping column 106 via a line 158.

In accordance with the preferred embodiment, the final step of the process includes distillation of the recovered THFA to remove water from the THFA to prepare it for re-use. The recovered THFA from holding vessels 118, 130 and 148 is combined via lines 122, 160 and 162, respectively, to form a line 164. Line 164 enters a distillation column 166. Distillation column 166 is equipped with a reboiler 168 that recirculates a portion of the column bottoms liquid by use of a line 170 that exits distillation column 166 and enters reboiler 168. Reboiler 168 discharges into line 172 which enters distillation column 166. The distillate of distillation column 166 is primarily water and enters a line 174. Line 174 enters a condenser 176 for condensing the water distillate. The condensate from condenser 176 enters line 178 and is stored in a storage tank 180. A portion of the water in storage tank 180 is recycled into the top of distillation column 166 as reflux via a line 182. The remainder of the water in storage tank 180 is sent to a waste treatment facility. Dry THFA exits from the bottom of column 166 and is sent to storage or reused at the beginning of the process, for example, in lines 84 and 100.

While this invention has been described with respect to preferred embodiments, it is apparent to one skilled in the art that various modifications will now be apparent and such are intended to be within the scope of the appended claims.

I claim:

1. A method of rerefining used oil containing lubricating oil comprising:

(a) removing from the used oil a volatile forecut to provide a resulting oil containing lubricating oil;

(b) evaporating the resulting oil in an evaporator unit at reduced pressure, greater than about 2.0 millimeters of mercury, to form heavy and light fractions, with a portion of said light fraction recycled and mixed into the resulting oil prior to the resulting oil entering the evaporator unit, in a quantity effective for lowering the vaporization temperature of the resulting oil to reduce the tendency of fouling, coking and cracking of the resulting oil during evaporation;

(c) mixing the light fraction not recycled into the resulting oil with an effective amount of tetrahydrofurfuryl alcohol for removing impurities from the light fraction; and (d) thereafter separating the light fraction from the tetrahydrofurfuryl alcohol.

2. The method as recited in claim 1 wherein the evaporator unit is an agitated thin film evaporator.

3. The method as recited in claim 1 wherein the evaporator unit is a wiped-film evaporator.

4. The method as recited in claim 1 wherein substantially all of the water, gasoline, and other similar volatile components that may be present in the used oil have been removed prior to step (a) of claim 1.

5. The method as recited in claim 1 wherein the volatile forecut has a flash point less than about 116° C.

6. The method as recited in claim 1 wherein the evaporation in step (b) of claim 45 occurs in the temperature range of about 265° F. to 480° F.

7. The method as recited in claim 1 wherein the ratio of the resulting oil to the light fraction recycled into the resulting oil is about 4:1.

8. The method as recited in claim 1 wherein the amount of the light fraction that is recycled is between about 5% and 300% by weight of the resulting oil.

9. The method as recited in claim 1 wherein said light fraction is light lube oil and the method further comprises:

(a) evaporating at reduced pressure the heavy fraction obtained from the evaporation of the resulting oil to form a heavy lube oil fraction and a residual fraction;

(b) mixing the heavy lube oil fraction with an effective amount of tetrahydrofurfuryl alcohol for removing impurities from the heavy lube oil fraction; and (c) thereafter separating the heavy lube oil from the tetrahydrofurfuryl alcohol.

10. The method as recited in claim 9 wherein a portion of the heavy lube oil fraction is recycled and mixed into the heavy fraction prior to evaporation thereof in a quantity effective for lowering the vaporization temperature of the heavy fraction to reduce the tendency of coking and cracking of the heavy fraction during evaporation thereof.

11. The method as recited in claim 9 wherein the heavy fraction is evaporated in an agitated thin film evaporator.

12. The method as recited in claim 9 wherein the heavy fraction is evaporated in a wiped-film evaporator.

13. The method as recited in claim 9 wherein the evaporation of the resulting oil occurs in the range of about 2 millimeters of mercury to 5 millimeters of mercury absolute.

14. The method as recited in claim 9 wherein the evaporation of the heavy fraction occurs in the range of about 0.5 millimeters of mercury to 3.0 millimeters of mercury absolute.

15. The method as recited in claim 9 wherein (a) the heavy lube oil and tetrahydrofurfuryl alcohol mixture is separated into a heavy oil raffinate and a light oil tetrahydrofurfuryl alcohol extract;

(b) the light lube oil and tetrahydrofurfuryl alcohol mixture is separated into a light lube oil raffinate and a light oil tetrahydrofurfuryl alcohol extract;

(c) tetrahydrofurfuryl alcohol is removed from the heavy oil raffinate by distilling and steam stripping; and (d) tetrahydrofurfuryl alcohol is removed from the light oil raffinate by distilling and steam stripping.

16. The process as recited in claim 15 further comprising:

distilling and steam stripping the light oil tetrahydrofurfuryl extract and the heavy oil tetrahydrofurfuryl extract to remove the tetrahydrofurfuryl alcohol therefrom.

17. The process as recited in claim 16 further comprising:

(a) combining the tetrahydrofurfuryl alcohol removed from the light oil raffinate, the heavy oil raffinate and the heavy and light oil tetrahydrofurfuryl extracts; and (b) distilling the water present in the mixture set forth in part (a) of this claim to produce dry tetrahydrofurfuryl alcohol that is suitable for use in step (c) of claim 1 or step (b) of claim 9.

18. The process as recited in claim 16 wherein the volume ratio of the heavy lube oil to tetrahydrofurfuryl alcohol is between about 0.5 and 2.0 and the volume ratio of the light lube oil fraction to tetrahydrofurfuryl alcohol is between about 0.5 and 2.0.

19. The process as recited in claim 16 wherein each of the heavy and light lube oil fractions are heated to a temperature in the range between about 125° F. and 250° F. prior to mixing with tetrahydrofurfuryl alcohol.

20. The process as recited in claim 19 wherein the tetrahydrofurfuryl alcohol is heated to a temperature of between about 125° F. and 250° F. prior to mixing with the lube oil fraction.

21. The process as recited in claim 16 wherein the distilling and steam stripping of the heavy and light oil raffinates occurs at reduced pressure.

22. The process as recited in claim 21 wherein the reduced pressure is between about 10 millimeters mercury and 100 millimeters mercury absolute.

23. The process as recited in claim 22 wherein the reduced pressure is about 20 millimeters mercury absolute at a temperature of about 160° F.

24. A method of rerefining used lubricating oil comprising:

(a) removing from the used oil a volatile forecut to provide a resulting oil that contains lubricating oil;

(b) evaporating the resulting oil in an evaporator at reduced pressure in the range of about 2.0 to 5.0 millimeters of mercury absolute and within a temperature range of about 265° F. to 500° F. to form a heavy fraction and a light lube oil fraction, said light lube fraction having a viscosity of between about 60 and 200 SSU at 100° F., with a portion of said light lube oil fraction being recycled and mixed into the resulting oil, prior to evaporation thereof, in a quantity effective for lowering the vaporization temperature of the resulting oil to reduce the tendency of fouling, coking and cracking of the resulting oil during evaporation;

(c) evaporating the heavy fraction in an evaporator obtained from the evaporation of the resulting oil to form a heavy lube fraction and a residual fraction, the evaporation of the heavy fraction occurring at reduced pressure within a range of between about 0.5 millimeters of mercury and 3.0 millimeters of mercury absolute and within a temperature range of about 315° F. and 600° F., with a portion of the heavy lube fraction being recycled and mixed into the heavy fraction, prior to evaporation thereof, in a quantity effective for lowering the vaporization temperature of the heavy fraction to reduce the tendency of coking and cracking of the heavy fraction during evaporation thereof;

(d) separately mixing the light lube oil and heavy fractions not recycled with an effective amount of tetrahydrofurfuryl alcohol for removing impurities from the light lube oil and heavy fractions; and (e) thereafter separating the tetrahydrofurfuryl alcohol from the light lube oil and heavy fractions.

25. The method as recited in claim 24 wherein the heavy fraction is evaporated with a wiped-film evaporator.

26. The method as recited in claim 24 wherein the amount of light lube oil fraction that is recycled is between about 5% and 300% by weight of the resulting oil and the amount of heavy lube fraction that is recycled is between about 5% and 300% by weight of the heavy fraction.

27. The process as recited in claim 24 wherein the volume ratio of the heavy lube fraction not recycled to tetrahydrofurfuryl alcohol is between about 0.5 and 2.0 and the volume ratio of the light lube oil fraction not recycled to tetrahydrofurfuryl alcohol is between about 0.5 and 2.0.

28. The process as recited in claim 24 wherein each of the heavy lube and light lube oil fractions are heated to a temperature in the range of between about 125° F. and 250° F. prior to mixing with tetrahydrofurfuryl alcohol.

29. The process as recited in claim 28 wherein the tetrahydrofurfuryl alcohol is heated to a temperature of between about 125° F. and 250° F. prior to mixing with the lube oil fractions.

* * * * *

UNITED STATES PATENT AND TRADEMARK OFFICE

CERTIFICATE OF CORRECTION

PATENT NO. : 4,360,420

DATED : November 23, 1982

INVENTOR(S) : Laird C. Fletcher et al.

It is certified that error appears in the above—identified patent and that said Letters Patent is hereby corrected as shown below:

Column 4, line 46, change "operation" to --separation--.
Column 7, lines 51 and 52, delete "into a line 35 and is heated in a heat exchanger 36 and".
Column 11, line 13, change "similar" to --similarly--.
Column 11, line 19, change "45" to --1--.

Signed and Sealed this

*Fourteenth* Day of *June 1983*

[SEAL]

*Attest:*

DONALD J. QUIGG

*Attesting Officer*

*Acting Commissioner of Patents and Trademarks*